US010023356B2

(12) United States Patent
Becklin

(10) Patent No.: US 10,023,356 B2
(45) Date of Patent: Jul. 17, 2018

(54) HYBRID STACKING SYSTEM FOR CONTAINERS

(71) Applicant: Becklin Holdings, Inc., Reno, NV (US)

(72) Inventor: Dennis M. Becklin, Grants Pass, OR (US)

(73) Assignee: Becklin Holdings, Inc., Grants Pass, OR (US)

( * ) Notice: Subject to any disclaimer, the term of this patent is extended or adjusted under 35 U.S.C. 154(b) by 551 days.

(21) Appl. No.: 14/499,837

(22) Filed: Sep. 29, 2014

(65) Prior Publication Data

US 2015/0083632 A1 Mar. 26, 2015

Related U.S. Application Data

(62) Division of application No. 12/834,237, filed on Jul. 12, 2010, now abandoned.

(51) Int. Cl.
*B65D 21/00* (2006.01)
*B65D 21/02* (2006.01)

(52) U.S. Cl.
CPC ..... *B65D 21/0202* (2013.01); *B65D 21/023* (2013.01); *B65D 21/0224* (2013.01)

(58) Field of Classification Search
CPC ..... B65D 21/0202; B65D 21/0224; B65D 21/023
USPC ..... 206/501, 503, 508, 509, 511; 220/23.86
See application file for complete search history.

(56) References Cited

U.S. PATENT DOCUMENTS 3,117,692 A * 1/1964 Carpenter ..... B65D 21/0219 206/501
3,616,943 A * 11/1971 Brink ..... B65D 21/0235 206/508
5,799,792 A * 9/1998 Abrums ..... B65D 21/0233 206/501
7,252,196 B1 * 8/2007 Koefelda ..... B65D 1/246 206/511
2005/0199459 A1 * 9/2005 Harvey ..... A45C 5/14 190/108
2008/0264820 A1 * 10/2008 Becklin ..... B65D 21/0222 206/508

* cited by examiner

*Primary Examiner* — Andrew T Kirsch
*Assistant Examiner* — Don M Anderson
(74) *Attorney, Agent, or Firm* — Lowe Graham Jones PLLC

(57) ABSTRACT

Universal wraps are used in the construction of a container centerbody. The wraps may take the form of a top and bottom wrap with complementary stacking patterns, in which the wraps create the centerbody. The wraps permit stacking of different-style containers regardless of which container is positioned as the bottom container. The universal wraps may include curved edge portions to seamlessly and aesthetically blend in with a side panel of the container. The stacking patterns of the wraps may take different forms with various shaped protuberances and recessed portions. Further, one or more of the wraps may have isolation features attached to or integrally formed with an interior surface of the wrap.

8 Claims, 8 Drawing Sheets

HYBRID STACKING SYSTEM FOR CONTAINERS

PRIORITY CLAIM

This invention is a divisional application of U.S. application Ser. No. 12/834,237 filed on Jul. 21, 2010.

FIELD OF THE INVENTION

This invention relates to a hybrid stacking system for containers having different stacking patterns, and more specifically relates to a hybrid stacking system having wraps on the containers for engaging different stacking patterns from different generations.

BACKGROUND OF THE INVENTION

Various types of containers, which may take the form of transit containers, rack-mount containers, tote containers or another type of container, are often utilized to receive and support delicate cargo, such as, but not limited to electronic, computer, optical and other types of equipment. These containers are often used in military and commercial environments and may be handled by persons, loading equipment, or both during transit and at other times. At least some of these containers have been designed to be stackable, and thus they include stacking elements or features arranged in a desired pattern. However, many of these containers may be of different types, sizes, models and versions, and thus have different stacking patterns that either do not permit the containers to be stacked together or that reduce the effectiveness, stability and/or efficiency of the containers when they are stacked together. By way of example, one company that manufactures containers having different stacking patterns is ECS Composites, Inc. out of Grants Pass, Oreg.

A variety of containers with stackability patterns include, but are not necessarily limited to, the following containers described in U.S. Pat. No. 6,457,599 to Apps et al.; U.S. Pat. No. 6,237,758 to Hsu; U.S. Pat. No. 6,186,345 to Robertson; U.S. Pat. No. 6,085,467 to Packrall et al.; U.S. Pat. No. 5,769,230 to Koefelda; U.S. Pat. No. 5,203,494 to Blomfield; and U.S. Pat. No. 4,655,360 to Juhanson.

SUMMARY OF THE INVENTION

Containers, such as transit containers, rack-mount containers, tote containers or other types of containers often include stacking patterns located on some portion of the container, for example the top and bottom surface or on the lid surfaces. Regardless, this stackability makes the containers more space efficient and easier to maneuver, especially in a field environment. As the containers evolve over time, sometimes it is either desired or necessary to modify the stacking pattern. However, users of the containers may still desire to stack containers having an older-style stacking pattern with containers having a newer-style stacking pattern, or vice-versa. Alternatively, the users may desire to stack containers that were simply designed with two different types of stacking patterns. Thus, in one embodiment, covers or wraps employing hybrid or complementary stacking patterns may be mounted, integrally formed with or otherwise attached to containers to permit the stacking of containers having different stacking patterns. By way of example, universal wraps (i.e., upper and lower wraps) are used to construct a centerbody to permit the container to be stacked with another, different type of container.

In one example of the invention, a wrap system for a container includes a first wrap having first wrap protuberances and first wrap recessed regions extending from a first wrap surface of a first wrap body, the first wrap protuberances and first wrap recessed regions arranged in a desired stacking pattern; and a second wrap having second wrap protuberances and second wrap recessed regions extending from a second wrap surface of a second wrap body, the second wrap protuberances and second wrap recessed regions arranged to stackably cooperate with the desired stacking pattern.

In another example of the invention, a container includes a container centerbody; a top wrap coupled to the container side walls creating the aforementioned centerbody, the top wrap having top wrap protuberances and top wrap recessed regions extending from a top wrap surface of a top wrap body, the top wrap protuberances and top wrap recessed regions arranged in a desired stacking pattern; and a bottom wrap having bottom wrap protuberances and bottom wrap recessed regions extending from a bottom wrap surface of a bottom wrap body, the bottom wrap protuberances and bottom wrap recessed regions arranged to stackably cooperate with the desired stacking pattern.

BRIEF DESCRIPTION OF THE DRAWINGS

The preferred and alternative embodiments of the present invention are described in detail below with reference to the following drawings.

DETAILED DESCRIPTION OF THE PREFERRED EMBODIMENT

Figure 8:
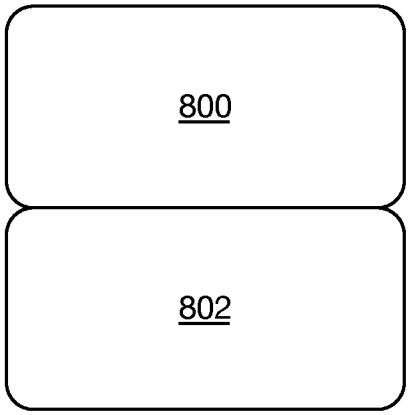
FIG. 8 shows a container stacked on another container.

Referring to FIG. 8, in an example of the present invention, universal wraps (i.e., upper and lower wraps) are used to create a container centerbody that permits the container to be stacked with another, different type of container. By way of example, the universal wraps include separate, but cooperating stacking patterns that allow a first generation container 800 or 802 to be stacked with a second or different generation container 802 or 800. Further, the universal wraps may advantageously eliminate the need for customers to replace the first generation containers with all second or different generation containers. For purposes of the description herein, the terms "first generation," "second generation" and "different generation" are broadly used to describe modified containers indicating non-compatible stacking patterns regardless of whether the containers were produced at different times.

Figure 1:
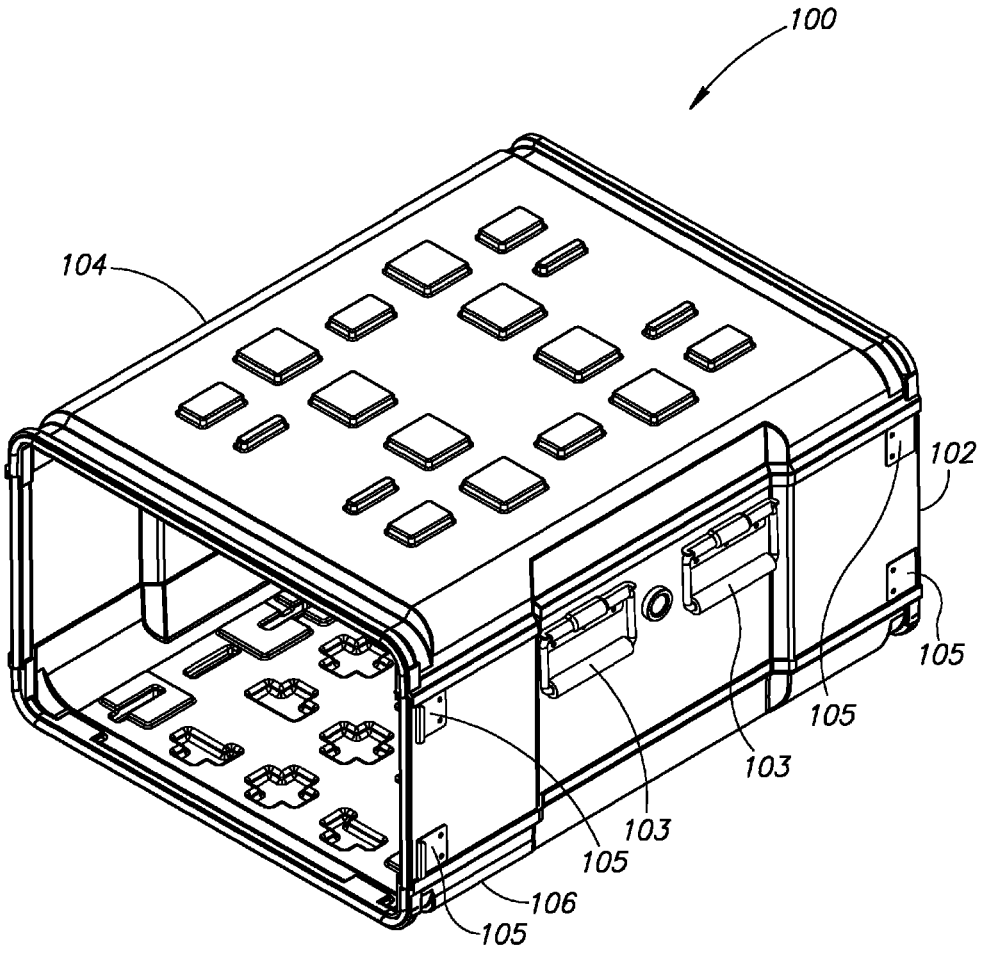
FIG. 1 shows a perspective view of a container having universal wraps with complementary stacking patterns according to an embodiment of the present invention.

FIG. 1 shows a container centerbody 100 having a side panel 102 coupled to a top universal wrap 104 and a bottom universal wrap 106. The side panel 102 may include handles 103 and latch mechanisms 105. In addition, the side panel 102 may be molded as a unitary component and manufactured from durable materials to include, but not limited to, various plastics, metals, fiber-reinforced composites or some combination of the above. In one embodiment, the wraps 104, 106 are bonded to the side panel 102. However, it is appreciated the wraps 104, 106 may be attached to the side panel 102 by other means, such as, but not limited to, an interference fit, a snap fit in which the wraps and side panels include cooperating snap portions, or fastening, for example with the wrap riveted to the centerbody.

Figure 2:
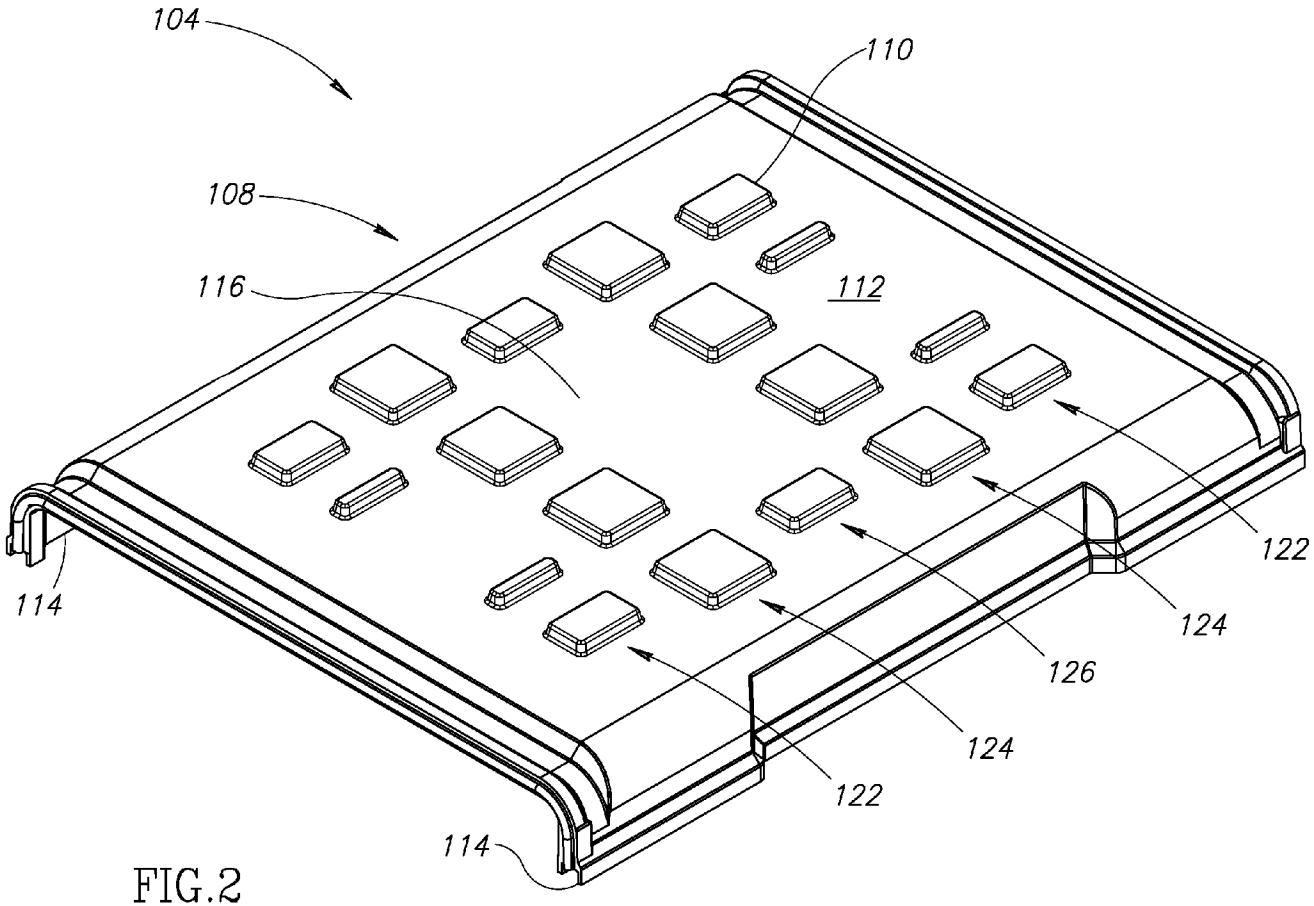
FIG. 2 shows a perspective view of a top universal wrap having a first stacking pattern according to an embodiment of the present invention.
Figure 3:
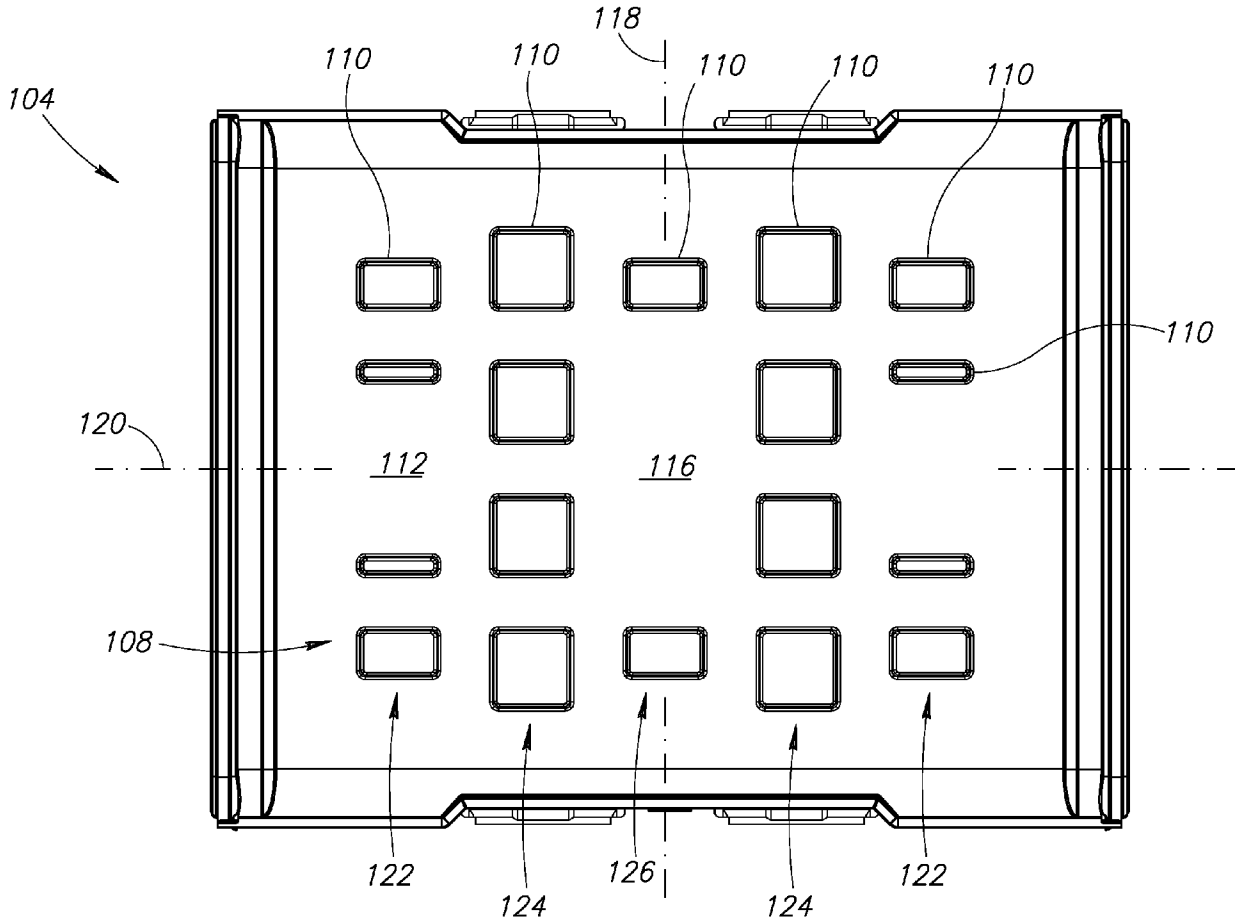
FIG. 3 shows a top plan view of the top universal wrap of FIG. 2.

FIGS. 2 and 3 show the top universal wrap 104 having a first stacking pattern 108 that may take the form of a plurality of spaced apart protuberances 110 extending from a surface 112. More specifically, the protuberances 110 may take the form of protrusions, projections, elements, features, bosses, ribs, etc. In addition, the protuberances 110 may take a variety of shapes, such as, but not limited to, quadrilaterals, polygons, circles, ellipses, etc. In one embodiment, the protuberances 110 are integrally molded with the surface 112 and side portions 114 Optionally, a portion 116 of the surface 112 may be reserved or made available for a label or other markings that may help identify the container 100 and/or the contents therein.

The stacking pattern 108 may be formed symmetrically with respect to axes 118, 120 (FIG. 3). In the illustrated embodiment, the protuberances 110 are arranged in rows or columns 122, 124, 126 such that they nest within complementary portions of the bottom wrap 106, as described in greater detail below. Alternatively, the protuberances 110 may be arranged to nest within complementary portions of a bottom side stacking pattern of another container of the same or different generations.

Figure 4:
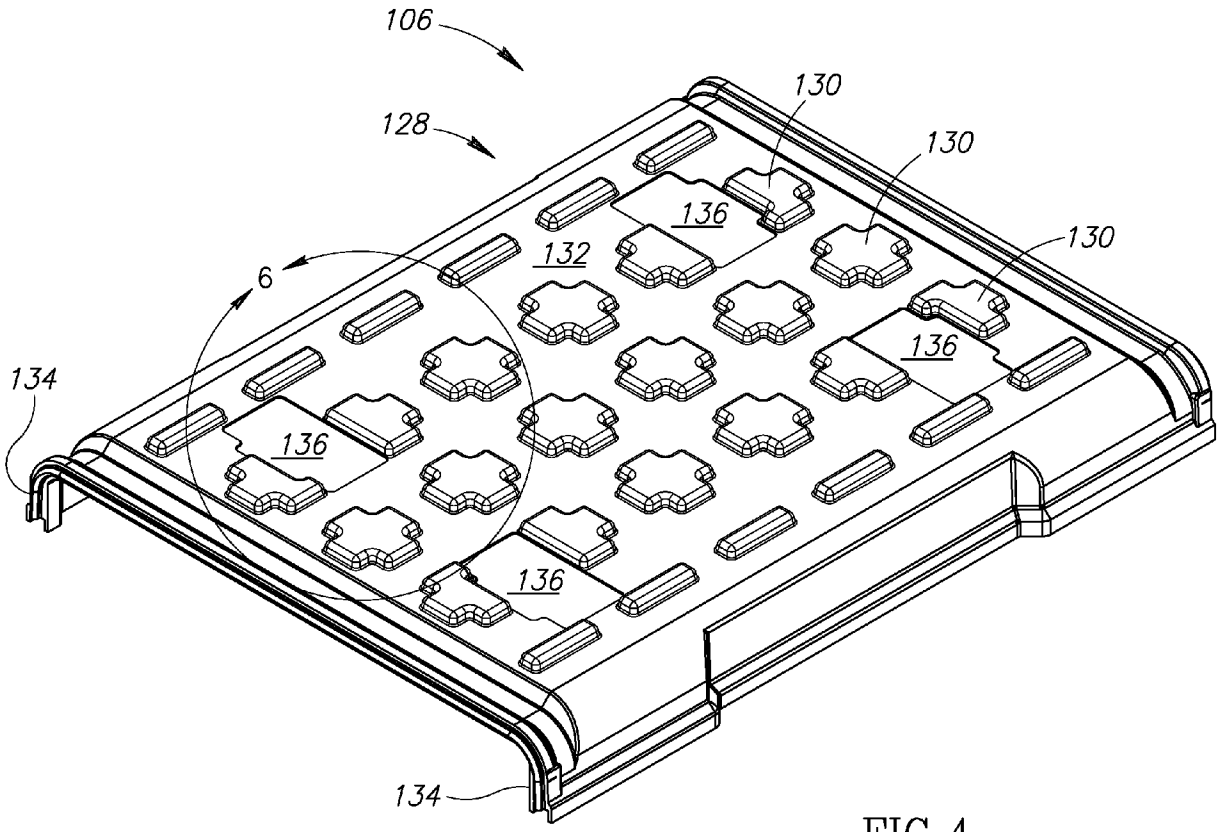
FIG. 4 shows a perspective view of a bottom universal wrap having a second stacking pattern according to an embodiment of the present invention.
Figure 5:
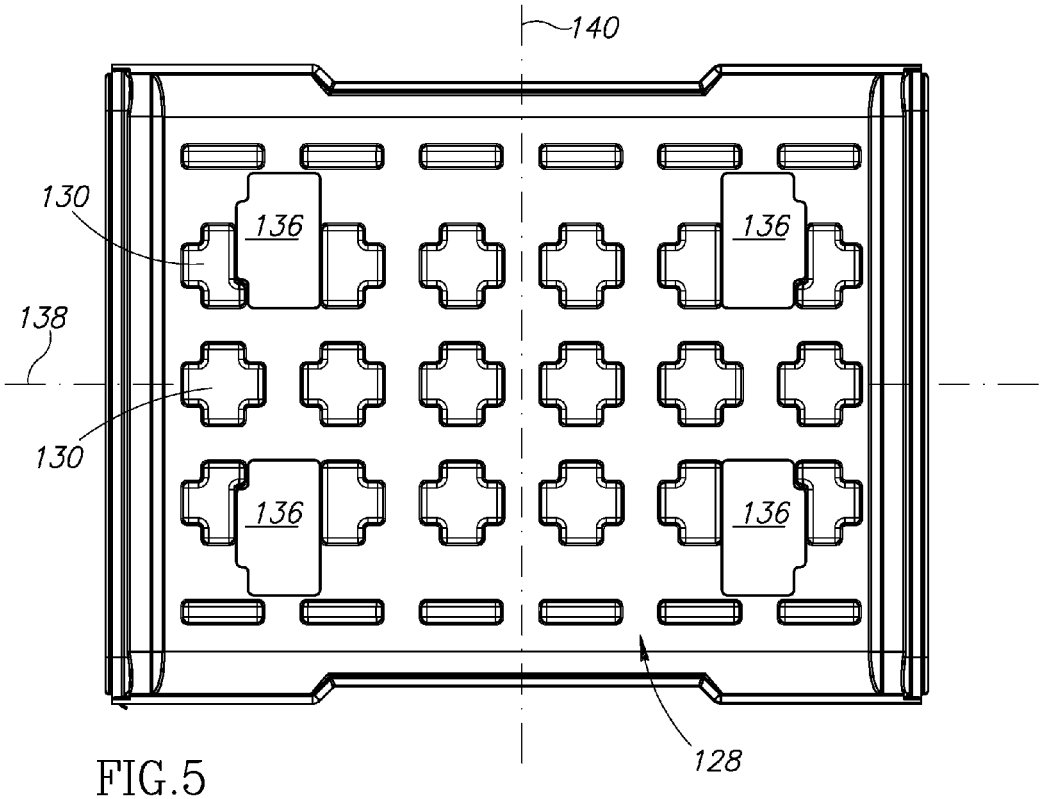
FIG. 5 shows a bottom plan view of the bottom universal wrap of FIG. 4.
Figure 6:
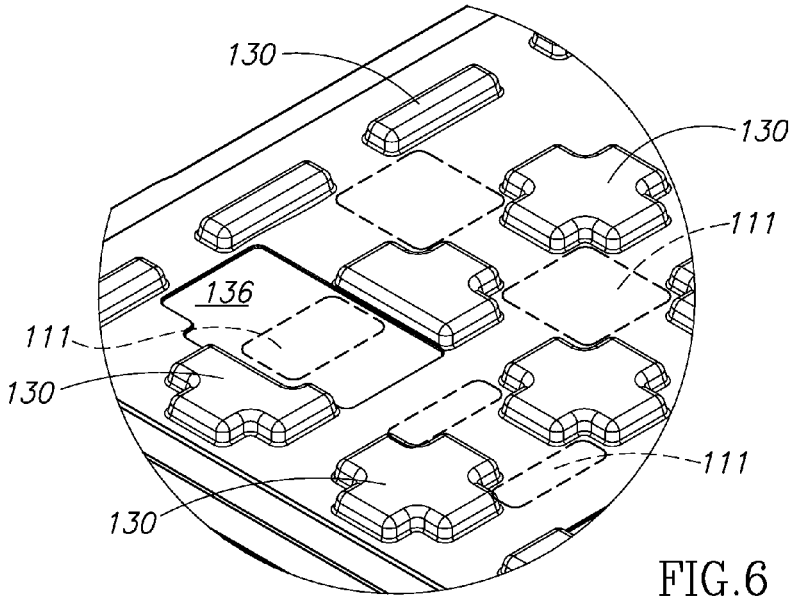
FIG. 6 shows close-up view of a portion of the second stacking pattern of the bottom universal wrap of FIG. 4.
Figure 9:
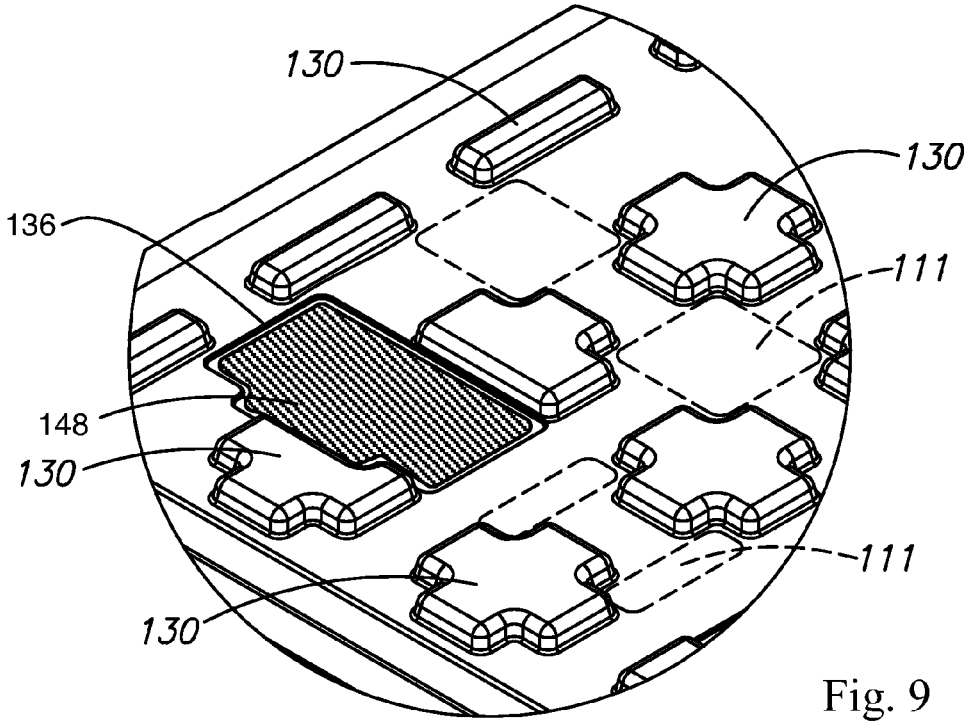
FIG. 9 shows protrusions of one stacking pattern inserted through recesses in a universal wrap.

FIGS. 4-6 show the bottom universal wrap 106 having a second stacking pattern 128 that may take the form of a plurality of spaced apart protuberances 130 extending from a surface 132. More specifically, the protuberances 130 may take the form of protrusions, projections, elements, features, bosses, ribs, etc. In addition, the protuberances 130 may take a variety of shapes, such as, but not limited to, quadrilaterals, polygons, circles, ellipses, plus-shapes, T-shapes, etc. In one embodiment, the protuberances 130 are integrally molded with the surface 132 and side portions 134. Optionally, a portion 136 of the surface 132 may be recessed or otherwise offset to nestingly engage with and/or provide clearance for previous generation protubrance patterns, such as protuberance 148 of FIG. 9. As best shown in FIG. 6, the recessed portions 136 include the selected regions 111, which are illustrated as footprints in dashed line format, where the footprints represent the outline of engaging protuberances. In the illustrated embodiment, the selected regions 111 receive the protuberances from row 122 of the top wrap 104 (FIG. 2).

Referring to FIG. 5, the protuberances 130 of the stacking pattern 128 may be formed symmetrically with respect to axes 138, 140. In addition, the recessed portions 136 may also be formed symmetrically with respect to the same axes 138, 140.

Figure 7:
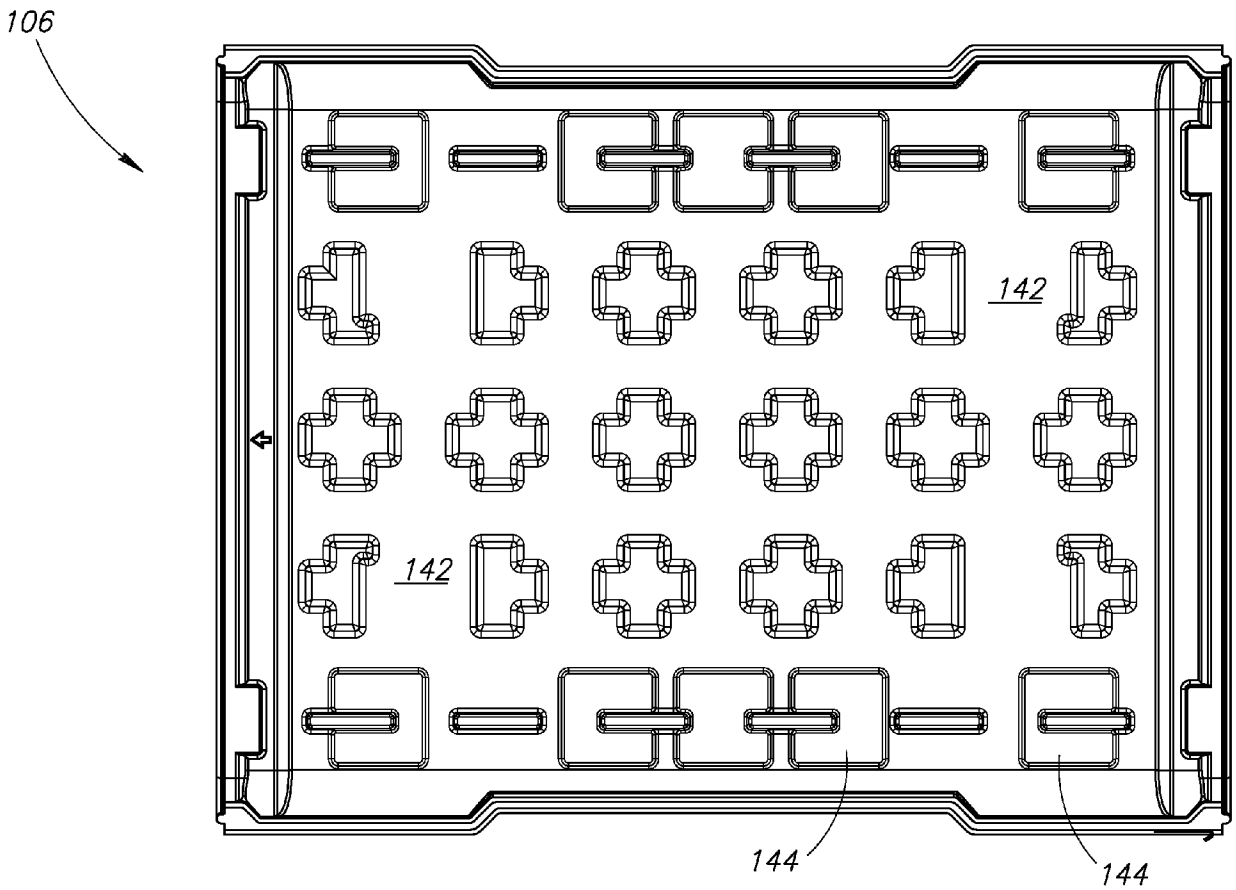
FIG. 7 shows a top plan (interior) view of the bottom universal wrap of FIG. 4.

FIG. 7 shows a top plan view of an interior surface 142 of the bottom wrap 106. As a means to streamline the manufacturing process, the bottom wrap 106 includes isolation features that correspond to an isolator foot print 144 extending from the interior surface 142. The isolation features 144 may be molded with the bottom wrap 106.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. An apparatus comprising:

a first generation container having a first upper surface defining a first upper stacking pattern including first upper protuberances and first upper recesses and having a first lower surface defining a first lower stacking pattern including first lower protuberances and first lower recesses sized and configured to nest with the first upper protuberances and recesses;

a second generation container having a second upper surface defining a second upper stacking pattern including second upper protuberances and second upper recesses and having a second lower surface defining a second lower stacking pattern including second lower protuberances and second lower recesses sized and configured to nest with the second upper protuberances and second upper recesses, the second upper protuberances and second upper recesses being unable to nest with the first lower protuberances and first lower recesses and the second lower protuberances and second lower recesses being unable to nest within the first upper protuberances and first upper recesses;

a hybrid container having a hybrid upper surface defining a hybrid upper stacking pattern including hybrid upper protuberances and hybrid upper recesses and having a hybrid lower surface defining a hybrid lower stacking pattern including hybrid lower protuberances and hybrid lower recesses sized and configured to nest with the hybrid upper protuberances and hybrid upper recesses, the hybrid upper protuberances and hybrid upper recesses being sized and configured to nest with both (a) the first lower protuberances and first lower recesses and (b) the second lower protuberances and second lower recesses, and the hybrid lower protuberances and hybrid lower recesses being able to nest with both (c) the first upper protuberances and first upper recesses and (d) the second upper protuberances and the second upper recesses;

wherein the first upper protuberances and first upper recesses have a different configuration than the second upper protuberances and second upper recesses;

wherein one of— the first upper protuberances and first upper recesses are nested with the hybrid lower protuberances and hybrid lower recesses and the second lower protuberances and second lower recesses are nested with the hybrid upper protuberances and hybrid upper recesses; and the first lower protuberances and first lower recesses are nested with the hybrid upper protuberances and recesses the second upper protuberances and second upper recesses nested with the hybrid lower protuberances and hybrid lower recesses.

2. A method comprising:

providing a first generation container having a first upper surface defining a first upper stacking pattern including first upper protuberances and first upper recesses and having a first lower surface defining a first lower stacking pattern including first lower protuberances and first lower recesses sized and configured to nest with the first upper protuberances and first upper recesses;

providing a second generation container having a second upper surface defining a second upper stacking pattern including second upper protuberances and second upper recesses and having a second lower surface defining a second lower stacking pattern including second lower protuberances and second lower recesses sized and configured to nest with the second upper protuberances and second upper recesses, the second upper protuberances and second upper recesses being unable to nest with the first lower protuberances and first upper recesses and the second lower protuberances and second lower recesses being unable to nest within the first upper protuberances and first upper recesses;

providing a hybrid container having a hybrid upper surface defining a hybrid upper stacking pattern including hybrid upper protuberances and hybrid upper recesses and having a hybrid lower surface defining a hybrid lower stacking pattern including hybrid lower protuberances and hybrid lower recesses sized and configured to nest with the hybrid upper protuberances and hybrid upper recesses, the hybrid upper protuberances and hybrid upper recesses being sized and configured to nest with both the first lower protuberances and first lower recesses and the second lower protuberances and second lower recesses, and the hybrid lower protuberances and recesses being able to nest with both the first upper protuberances and first upper recesses and the second upper protuberances and second upper recesses;

wherein the first upper protuberances and first upper recesses have a different configuration than the second upper protuberances and second upper recesses;

one of stacking the first container and the second container with the hybrid container having the first upper protuberances and first upper recesses nested with the hybrid lower protuberances and hybrid lower recesses and the second lower protuberances and second lower recesses nested with the hybrid upper protuberances and hybrid upper recesses; and stacking the first container and the second container with the hybrid container having the first lower protuberances and first lower recesses nested with the hybrid upper protuberances and hybrid upper recesses and the second upper protuberances and second upper recesses nested with the hybrid lower protuberances and hybrid lower recesses.

3. A container system comprising:

a first container including— an upper container surface having a plurality of upper protuberances protruding outwardly from the upper container surface, the plurality of upper protuberances defining a first stacking pattern; and a lower container surface having a plurality of lower protuberances extending outwardly from the lower container surface, the plurality of lower protuberances sized and positioned to nest with protuberances according to the first stacking pattern, the lower container surface further defining a plurality of recesses extending through the lower container surface, the plurality of recesses sized and positioned to receive protuberances corresponding to a second stacking pattern different from the first stacking pattern, the lower container surface extending completely between opposing lateral sides of the first container and each recess of the plurality of recesses having a closed perimeter; and first and second sidewalls positioned opposite one another and connected to the upper container surface and the lower container surface.

4. The container system of claim 3, further comprising a second container having second protuberances according to the second stacking pattern, the second protuberances being positioned within the plurality of recesses.

5. A method comprising:

providing a first container and a second container, each container of the first container and the second container including— an upper container surface having a plurality of upper protuberances protruding outwardly from the upper container surface, the plurality of upper protuberances defining a first stacking pattern; and a lower container surface having a plurality of lower protuberances extending outwardly from the lower container surface, the plurality of lower protuberances sized and positioned to nest with protuberances according to the first stacking pattern, the lower container surface further defining a plurality of recesses extending through the lower container surface, the plurality of recesses sized and positioned to receive protuberances corresponding to a second stacking pattern different from the first stacking pattern, the plurality of recesses each having a closed perimeter; and first and second sidewalls positioned opposite one another and connected to the upper container surface and the lower container surface;

stacking the first container on the second container having the plurality of lower protuberances of the first container nested among the plurality of upper protuberances of the second container.

6. The method of claim 5, further comprising:

providing a third container having third protuberances according to the second stacking pattern; and stacking the second container on the third container having the third protuberances positioned within the plurality of recesses of the second container.

7. The method of claim 5, wherein the lower container surface of each container of the first container and the second container extends completely between opposing lateral sides of the each container.

8. The container system of claim 3, wherein each recess of the plurality of recesses intersects a protuberance of the plurality of lower protuberances.

* * * * *